US011241090B1

(12) United States Patent
Pallis

(10) Patent No.: US 11,241,090 B1
(45) Date of Patent: Feb. 8, 2022

(54) DEVICE HAVING FLATTENABLE CAVITIES AND PROTRUSIONS WITH SECONDARY FEATURES

(71) Applicant: Tina Marie Pallis, Mercer Island, WA (US)

(72) Inventor: Tina Marie Pallis, Mercer Island, WA (US)

( * ) Notice: Subject to any disclaimer, the term of this patent is extended or adjusted under 35 U.S.C. 154(b) by 68 days.

(21) Appl. No.: 16/133,589

(22) Filed: Sep. 17, 2018

Related U.S. Application Data

(63) Continuation-in-part of application No. 13/999,584, filed on Mar. 10, 2014, now Pat. No. 10,076,186, which is a continuation-in-part of application No. 12/965,686, filed on Dec. 10, 2010, now abandoned.

(60) Provisional application No. 61/852,416, filed on Mar. 15, 2013.

(51) Int. Cl.

| | |
|---|---|
| ***A47B 77/02*** | (2006.01) |
| ***A47G 23/03*** | (2006.01) |
| ***A47B 13/08*** | (2006.01) |
| *A47B 77/06* | (2006.01) |

(52) U.S. Cl.
CPC ..... *A47B 77/022* (2013.01); *A47B 13/08* (2013.01); *A47G 23/03* (2013.01); *A47B 77/06* (2013.01); *A47B 2077/027* (2013.01)

(58) Field of Classification Search
CPC ..... A47B 77/022; A47B 13/08; A47B 77/06; A47B 2077/027; A47G 23/03
See application file for complete search history.

(56) References Cited

U.S. PATENT DOCUMENTS

| | | | |
|---|---|---|---|
| 5,948,707 | A | 9/1999 | Crawley |
| 6,372,323 | B1 | 4/2002 | Kobe |
| 6,673,409 | B1 | 1/2004 | Wheatley |
| 6,774,067 | B2 | 8/2004 | Dermott |
| 6,896,958 | B1 | 5/2005 | Cayton et al. |
| 7,378,382 | B2 | 5/2008 | Serobian et al. |
| 7,625,625 | B2 | 12/2009 | Rios et al. |
| 7,921,500 | B2 | 4/2011 | Linzell |
| 2008/0008856 | A1 | 1/2008 | Weng |

(Continued)

FOREIGN PATENT DOCUMENTS

| | | | | |
|---|---|---|---|---|
| GB | 199159 A | * | 6/1923 | ..... A47G 23/03 |
| GB | 359895 A | * | 10/1931 | ..... A47G 23/03 |

OTHER PUBLICATIONS

U.S. Appl. No. 13/999,584, "Final Office Action", dated Sep. 14, 2016, 14 pages.

(Continued)

*Primary Examiner* — Brian Handville
(74) *Attorney, Agent, or Firm* — Knobbe, Martens, Olson & Bear, LLP

(57) ABSTRACT

An apparatus having one or more cavities and corresponding one or more protrusions is disclosed. The one or more cavities and corresponding one or more protrusions can be flattened to cause the apparatus to adhere to an object. Thus, the apparatus can be used in applications where adherence of the apparatus to an object is desired. The apparatus can also act as a protective layer to buffer and protect a surface of the object. It is also possible to maintain the surface's visual appearance, if beneficial. The apparatus can also be used in applications where buffering and protection from friction is not needed.

27 Claims, 12 Drawing Sheets

(56) References Cited

U.S. PATENT DOCUMENTS

| | | | | |
|---|---|---|---|---|
| 2008/0245947 | A1 | 10/2008 | Web | |
| 2009/0064990 | A1 | 3/2009 | Wilkens et al. | |
| 2009/0324872 | A1* | 12/2009 | Leng | B32B 3/04 428/73 |
| 2012/0328349 | A1 | 12/2012 | Isaac | |

OTHER PUBLICATIONS

U.S. Appl. No. 13/999,584, "Non-Final Office Action", dated Feb. 17, 2016, 12 pages.
U.S. Appl. No. 13/999,584, "Non-Final Office Action", dated Sep. 5, 2017, 12 pages.
U.S. Appl. No. 13/999,584, "Notice of Allowance", dated May 7, 2018, 8 pages.
U.S. Appl. No. 13/999,584, "Restriction Requirement", dated Oct. 13, 2015, 5 pages.
U.S. Appl. No. 13/999,584, U.S. Patent Application, filed Mar. 10, 2014, Titled: Device Having Flattenable Cavities and Protrusions.
Owen, M.J., Why Silicones Behave Funny, Jul. 2010, Dow Corning Corporation, obtained from https://web.archive.org/web/20100714140547/https://www.dowcorning.com/content/publishedlit/01-3078-01.pdf (Year: 2010).

* cited by examiner

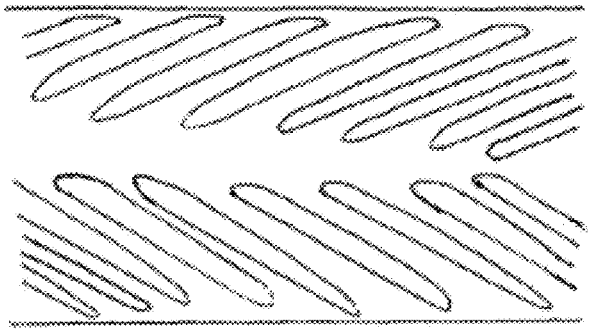
FIG. 20
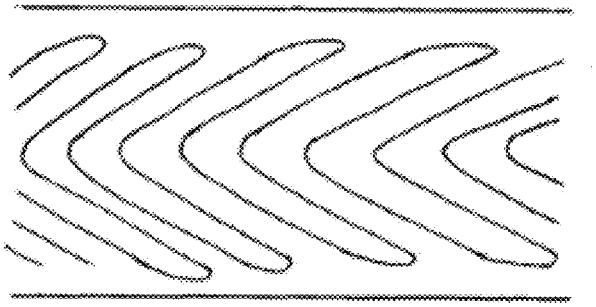
FIG. 21
FIG. 22
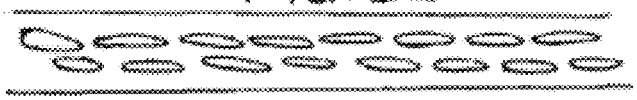
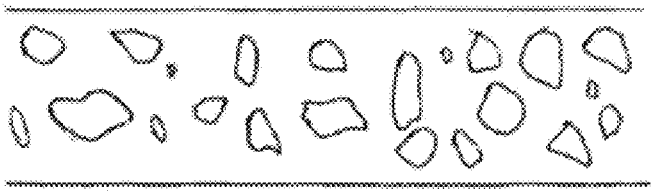
FIG. 23

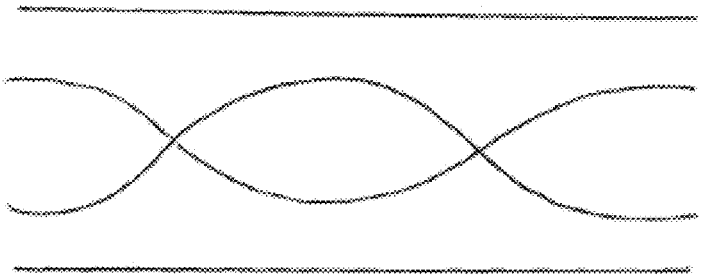
FIG. 24
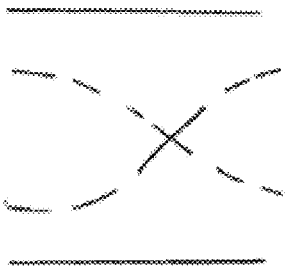
FIG. 25
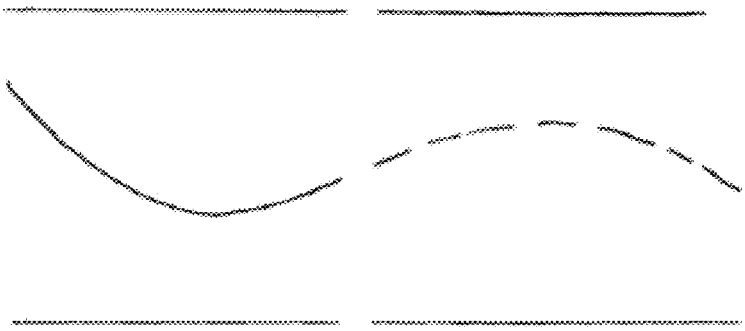
FIG. 26
FIG. 27
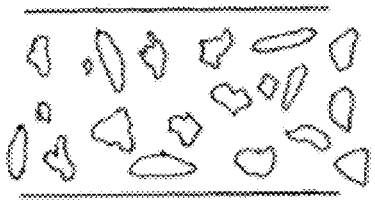
FIG. 28

DEVICE HAVING FLATTENABLE CAVITIES AND PROTRUSIONS WITH SECONDARY FEATURES

CROSS-REFERENCES TO RELATED APPLICATIONS

This application is a continuation-in-part of U.S. patent application Ser. No. 13/999,584, filed Mar. 10, 2014, now U.S. Pat. No. 10,076,186 issued on Sep. 18, 2018, which is a continuation-in-part of U.S. patent application Ser. No. 12/965,686, filed Dec. 10, 2010, and claims the benefit of U.S. Provisional Patent Application No. 61/852,416, filed Mar. 15, 2013, the entireties of which are incorporated by reference.

BACKGROUND OF THE INVENTION

Deriving the full utility of a countertop, while at the same time enjoying the countertop appearance, is not always easy. Many countertop types that are popular today, for example the natural stone (granite or marble) countertop, the chic utilitarian concrete countertop, the tile countertop and the recycled glass countertop have a Brinell Hardness Number in excess of 500 and may therefore be classified as super hard surfaces. Also, in this category are engineered stone materials, such as those available under the trademarks Zodiaq® by Dupont®, Viatera® by LG and Eco® by Cosentino®.

Another category of materials commonly used for countertops is defined as having hard surfaces. Examples of materials in this category are laminates such as Formica® and Wilson Art®, and solid surfaces such as Corian®, HI-MACS®, glass, etc.

The above stated surfaces are subject to being easily deformed, such as scratched, abraded, scuffed, scorched, etc., when hard utensils are improperly placed on the surface or through normal wear. Additionally, the super hard surfaces do not appreciably yield to an applied force, for example when a kitchen user places a ceramic dish or glass drinking vessel on the countertop. Not only is there an unpleasant "clack" sound, but the user may perceive an unpleasant physical shock or jolt to the arm, due to the un-buffered contact of dish and countertop. This jolt, and the awareness of potential damage to dish or glass drinking vessel, may slow down the user in placing dishes on the countertop, when for example, unloading a dishwasher.

Also, those wishing to use the countertop as a surface on which to place a pot, pan, dishware or bakeware that is in the process of being cleaned by scrubbing, may find that there is an unpleasant grating noise caused by friction between the bakeware and the super hard countertop surface.

Accordingly, those wishing to get full and convenient use of a countertop, while still enjoying the countertop's elegant appearance, do not currently have a good option for achieving these objectives.

The term "countertop" as used herein is not limited to a kitchen environment, but includes any conceivable workspace with a top surface needing protection.

BRIEF SUMMARY OF THE INVENTION

According to some embodiments, a device may include a sheet having a first surface and a second surface such that the first surface and the second surface are substantially opposite each other. The first surface may include a first plurality of concave cavities and said second surface having a first plurality of convex protrusions corresponding to said first plurality of concave cavities. The height of the concave cavities may correspond to the height of said convex protrusions throughout the sheet, and the width of the concave cavities may correspond to the width of the convex protrusions throughout the sheet. The concave cavities and the convex protrusions throughout the sheet are configured to be flattened to cause the sheet to adhere to an object by removing at least one of excess air, or excess wetting agent, if used, disposed between the second surface of the sheet and the object, with the second surface facing the object.

According to some embodiments, a device may include a sheet having a first surface and a second surface opposite the first surface, a plurality of concave cavities formed on the first surface; and a plurality of convex protrusions formed on the second surface. Each concave cavity may be formed within a corresponding convex protrusion. The sheet may include a material surrounding each of the concave cavities and corresponding convex protrusions. The sheet may have at least two discrete portions, in which a first of the discrete portions may include a first corresponding concave cavity and convex protrusion, and a second of the discrete portions may include a second corresponding concave cavity and convex protrusion. The discrete portions may be separated from each other by the material. The thickness of the material can be different than the thickness between the concave cavities and convex protrusions throughout the sheet. A transition from the concave cavities and convex protrusions to the material may form a flattened "S" shape. The concave cavities and convex protrusions can be configured to be flattened to make the sheet adhere to a surface (e.g., a surface external to the device) by removing at least one of excess air, or excess wetting agent, if used, disposed between said sheet and the surface.

According to some embodiments, a device may include a sheet having a first surface and a second surface such that the first surface and the second surface are substantially opposite each other. The first surface may include at least one concave cavity and the second surface may include at least one convex protrusion corresponding to the at least one concave cavity. At least one concave cavity can be formed within the at least one convex protrusion. The height of the at least one concave cavity may correspond to the height of the at least one convex protrusion. The width of the at least one concave cavity may correspond to the width of the at least one convex protrusion. The sheet may include a material surrounding the at least one concave cavity and the at least one convex protrusion. The at least one concave cavity and the at least one convex protrusion can be configured to be flattened to cause the sheet to adhere to a surface (e.g., a surface external to the device) by removing at least one of excess air, or excess wetting agent, if used, disposed between the sheet and the surface.

BRIEF DESCRIPTION OF THE DRAWINGS

A better understanding of the embodiments of the device and method may be had by reference to the drawing figures wherein:

FIG. 20 is an alternative embodiment of the invention.

FIG. 21 is an alternative embodiment of the invention.

FIG. 22 is an alternative embodiment of the invention.

FIG. 23 is an alternative embodiment of the invention.

FIG. 24 is an alternative embodiment of the invention.

FIG. 25 is an alternative embodiment of the invention.

FIG. 26 is an alternative embodiment of the invention.

FIG. 27 is an alternative embodiment of the invention.

FIG. 28 is an alternative embodiment of the invention.

DETAILED DESCRIPTION OF THE EMBODIMENTS

Figure 1:
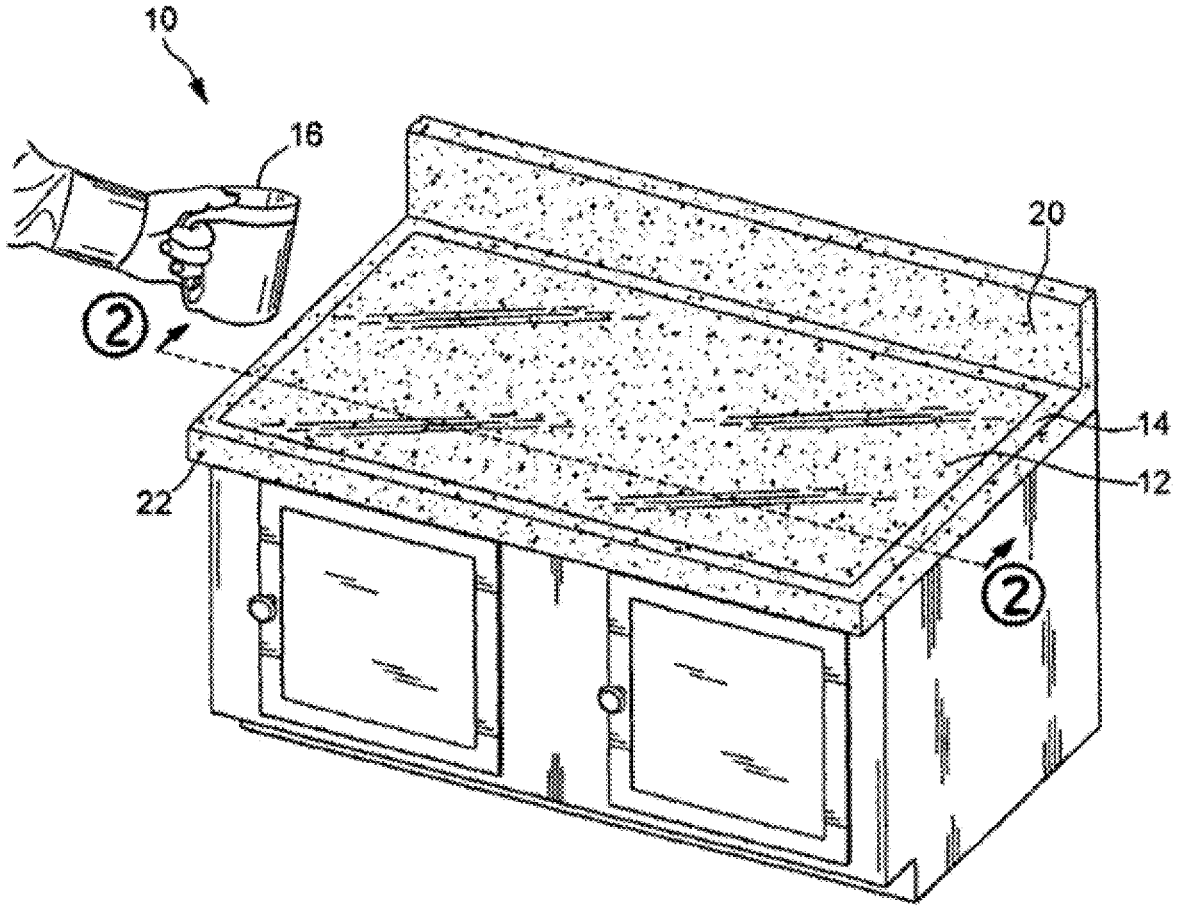
FIG. 1 is a perspective view of a cabinet having a countertop utilizing the present invention showing the unaltered beauty of the countertop while protecting the countertop's surface from an about to be placed utensil.
Figure 2:
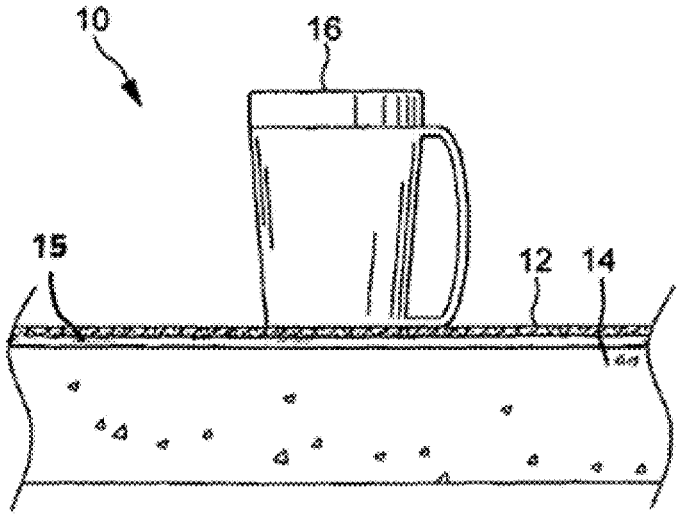
FIG. 2 is a cross sectional view showing the presence of a wetting agent at the interface of a silicone sheet of the present invention and the countertop's surface.
Figure 3:
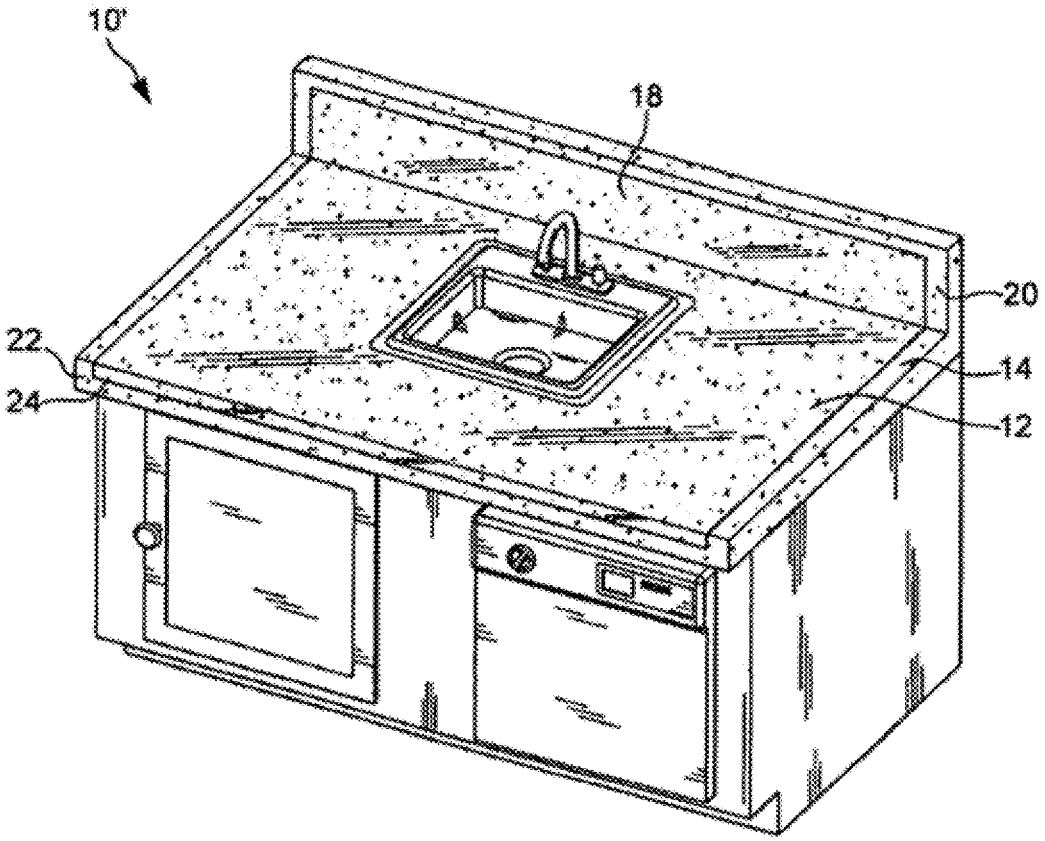
FIG. 3 is a perspective view showing the parameters of FIG. 1 applicable to both a countertop and a backsplash.

First Embodiment—FIG. 1, FIG. 2 and FIG. 3

Referring to FIG. 1, FIG. 2 and FIG. 3, a first embodiment of the present invention is shown. The first embodiment relates to a method of buffering the surface 14 of a countertop on a cabinet 10 while at the same time maintaining the surface's 14 visual appearance. The method includes wetting either (1) one surface of a substantially transparent silicone sheet 12, which may have a thickness of 4 mm or less, with a wetting agent 15 or (2) the countertop surface 14 with the wetting agent 15, or (3) both the surface of the silicone sheet 12 and the countertop surface 14 and then, placing the silicone sheet 12 adjacent to the countertop surface 14 so that the wetting agent 15 is located therein between the silicone sheet 12 surface and the countertop surface 14 and finally, removing the resulting excess wetting agent and trapped air at the interface. Removal of the excess water and trapped air may be accomplished by: rolling, with a force directed toward the sheet 12, the unwetted nearside surface of the silicone sheet 12 with a cylindrically shaped object such as a roller; sliding an object over the upper surface of sheet 12 such as the bottom of a drinking glass (which in this case must also be wetted) with a force directed toward the sheet 12; by repeatedly placing a flat surface of an object against the silicone sheet 12 with a force directed toward the sheet 12; etc.

After accomplishing the above described method, it should be noted that the visual appearance and beauty of the countertop surface 14 is preserved as seen through the silicone sheet 12. The resulting uniform thin thickness of the wetting agent 15 and removal of air essentially does not effectively obstruct the light passing through the applied silicone sheet 12, and therefore, the visual appearance of the countertop surface 14 is maintained. Also, the interaction between the resulting uniform thin thickness of the wetting agent 15, the absence of air, the lower surface of the silicone sheet 12 and the countertop surface 14 helps to stabilize the silicone sheet 12 on the countertop surface 14.

In addition, since silicone is a relatively soft material, the applied silicone sheet 12 will buffer and thus protect the countertop surface 14 from deformation like scratches and scuffing from contact with a utensil 16 and other relatively hard objects and will also aid in keeping items in place, so as not to inadvertently slide. Furthermore, since the silicone surface 12 is relatively heat resistant, it will protect the countertop surface 14 from contact with hot utensils, such as utensil 16 and other objects without fear of the silicone melting or scorching when it comes into contact with hot objects. Moreover, the application of the first embodiment will aid in protecting a user from physical shock as described in the Background section.

Figure 4:
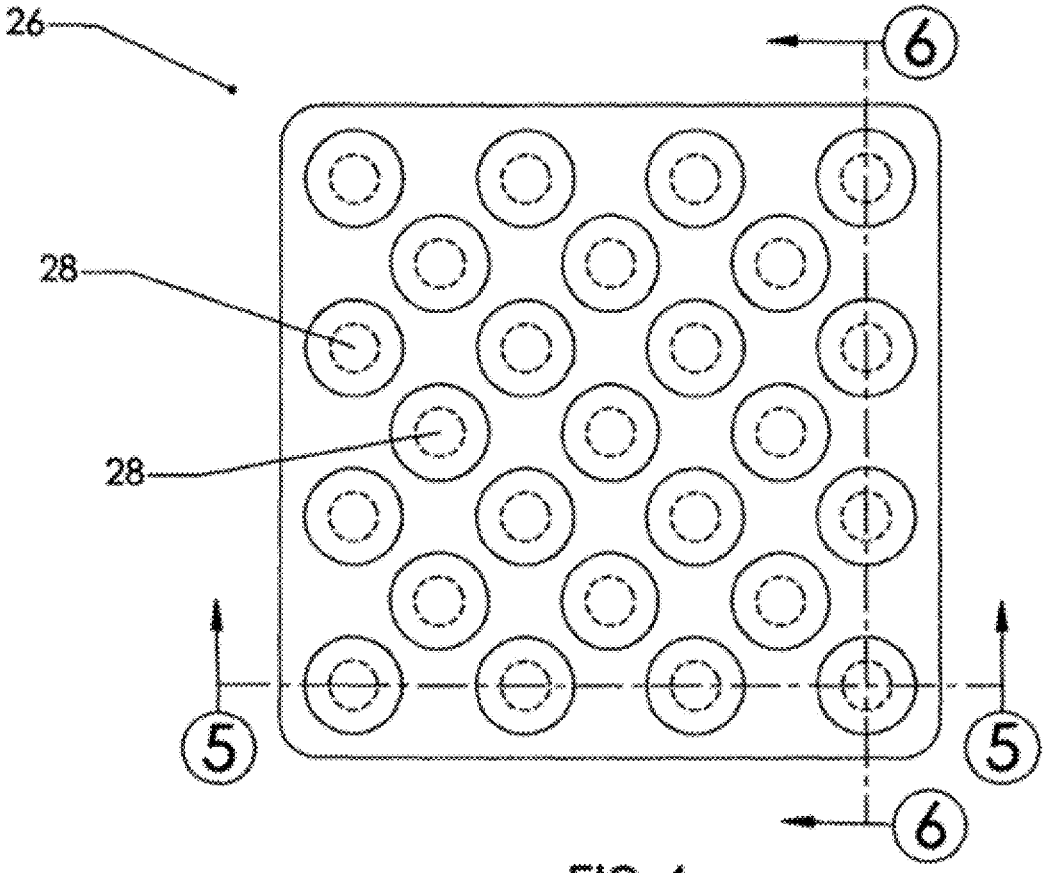
FIG. 4 is a first surface view of a silicone sheet of the present invention having substantially circular concave cavities and corresponding convex protrusions facing upwards.
Figure 5:
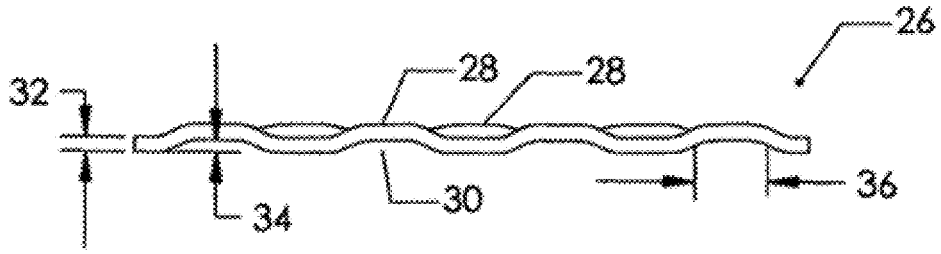
FIG. 5 is a cross sectional view of the silicone sheet shown in FIG. 4.
Figure 6:
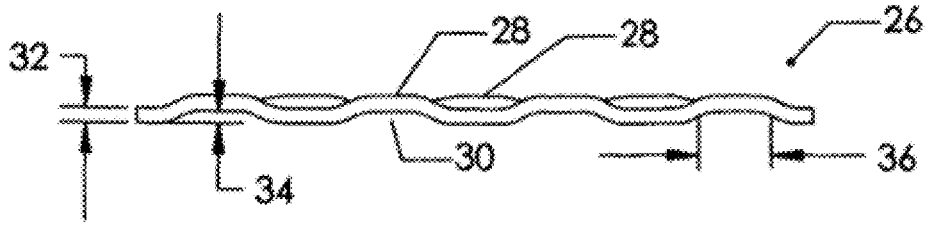
FIG. 6 is a cross sectional view of the silicone sheet shown in FIG. 4 orientated ninety degrees to that of FIG. 5.

Second Embodiment—FIGS. 4-6

Referring to FIGS. 4-6, a second embodiment of the present invention is shown, which can be used for adhering the apparatus of the invention to a surface 14. The second embodiment is a device for buffering the surface 14 of a countertop on a cabinet 10 while at the same time maintaining the surface's 14 visual appearance. The device includes a substantially transparent silicone sheet 26 having a plurality of spaced concave cavities 30 on its second side and corresponding convex protrusions 28 on its first side.

Either the first side, the second side or both sides of sheet 26 can be specifically designed to be positioned on the countertop surface 14.

In the same manner as in the first embodiment, a wetting agent 15 is applied before placing the sheet 26 on the countertop surface 14 and then the air and excess wetting agent 15 is removed as stated in the first embodiment. If sheet 26 is designed for placement of the second side or concave cavities 30 next to the countertop surface 14, the concave cavities 30 trap air and wetting agent 15, thereby helping to stabilize the silicone sheet 26 on the countertop surface 14 when the air and excess wetting agent 15 are forced out by pressing on the corresponding convex protrusions 28. If sheet 26 is designed for placement of the first side or the protrusions 28 next to the countertop surface 14, the area between the protrusions 28 and the flat portion of sheet 26 contact surface trap air and wetting agent 15, thereby helping to stabilize the silicone sheet 26 on the countertop surface 14 when the air and excess wetting agent 15 are forced out by pressing on the pocket 30 side of sheet 26.

As with the first embodiment, adding a wetting agent 15 such as water to the interface between the countertop surface 14 and the sheet 26 further enhances both the visual preservation of the countertop surface 14 as seen through the sheet 26 and the stability of the sheet 26 on the countertop surface 14.

The thickness 32 may be relatively uniform throughout the sheet 26 and as a result, the upper surface of sheet 26 is essentially flat and planar when placed on a planar countertop surface 14 and the excess air and wetting agent 15 are removed. The thickness 32, can be uniform or vary throughout the sheet 26. The height 34 of the cavities 30 and the width and/or length 36 of the cavities 30 can be uniform or vary throughout the sheet 26. The thickness as measured between the cavities 30 and the protrusions 28 can be different from that of the thickness of the sheet 26. The transition from the cavities 30 and the protrusions 28 to the flat portion of sheet 26 can be gradual like a flattened or straightened "S" and have relatively large fillet radii and alternately, this transition area can be of any configuration.

To reiterate, the design of the second embodiment can be such that only the cavities 30 side or only the protrusions 28 side is positioned on the countertop surface 14 or the design can be such that either the pocket 30 side or the protrusions side 28 can be positioned on the countertop surface 14.

Operation of the Second Embodiment

To operate or install the second embodiment on a countertop surface 14 and in the same manner as in the first embodiment, a wetting agent 15 is applied before placing the sheet 26 on the countertop surface 14. The applicable side of sheet 26 is then placed on the countertop surface 14. Excess air and wetting agent 15 are then removed usually by rolling a cylindrical object over the unwetted nearside surface of the sheet 26 with a force directed toward the countertop surface 14. After excess air and wetting agent 15 have been removed, the sheet will follow the contour of the countertop surface 14 and the nearside surface of the sheet 26 will be essentially a uniform distance from the surface of the countertop surface 14 as shown in FIGS. 1, 2 and 3.

Third Embodiment—FIGS. 1-6

Referring to FIGS. 1-6, a third embodiment of the present invention is shown, which can be used for adhering the apparatus of the invention to a surface 14. The third embodiment relates to a method of buffering the surface 14 of a countertop on a cabinet 10 while at the same time maintaining the surface's 14 visual appearance. The third embodiment is the same as the first embodiment with the exception that sheet 12 is replaced with sheet 26. Furthermore, similar to the second embodiment, either the cavities 30 side or the protrusions 28 side, as dependent on the applicable design (reference the second embodiment), is positioned adjacent to the countertop surface 14.

Figure 7:
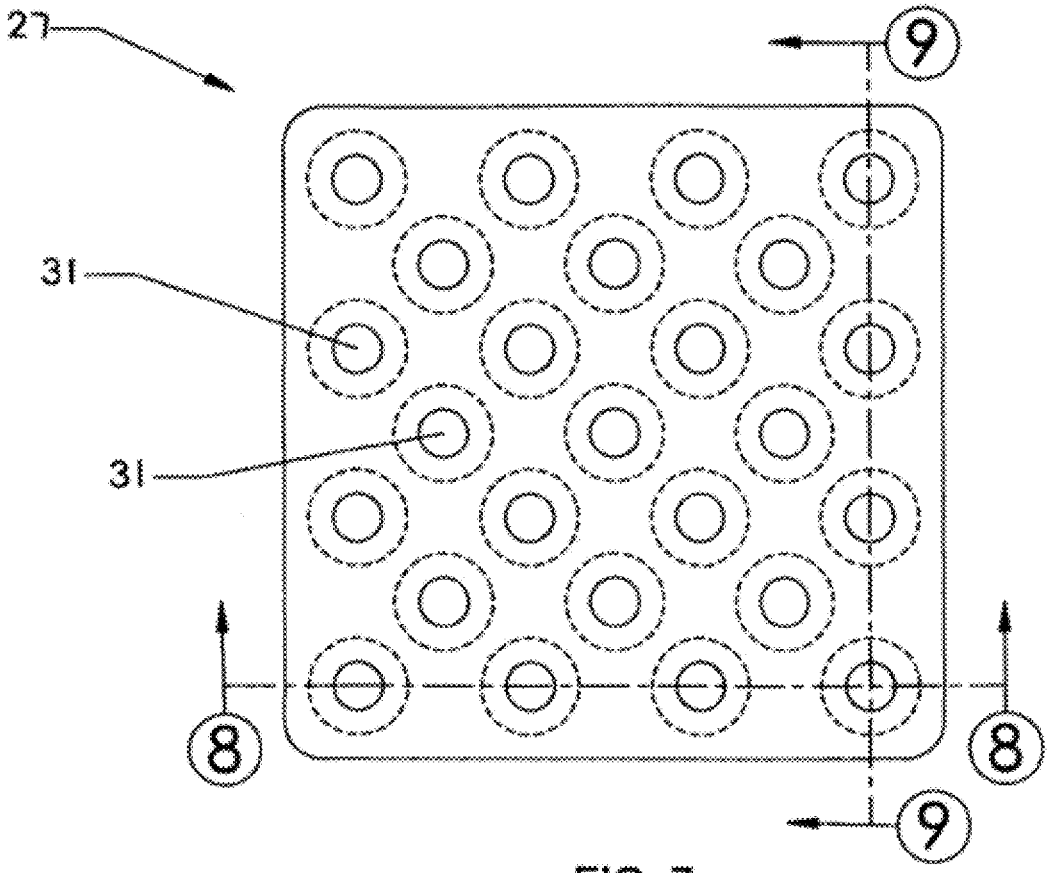
FIG. 7 is a first surface view of a silicone sheet of the present invention having substantially circular concave cavities and corresponding convex protrusions with the cavities facing upward.
Figure 8:
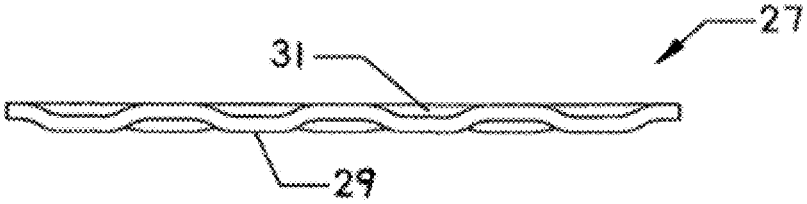
FIG. 8 is a cross sectional view of the silicone sheet shown in FIG. 7.
Figure 9:
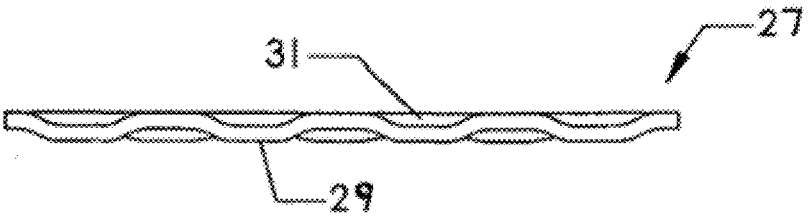
FIG. 9 is a cross sectional view of the silicone sheet shown in FIG. 7 orientated ninety degrees to that of FIG. 8.

Fourth Embodiment—FIGS. 7-9

Referring to FIGS. 7-9, a fourth embodiment of the present invention is shown, which can be used for adhering the apparatus of the invention to a surface 14. The fourth embodiment is a device for buffering the surface 14 of a countertop on a cabinet 10 while at the same time maintaining the surface's 14 visual appearance. The fourth embodiment is the same as the second embodiment with the exception that sheet 26 is replaced with sheet 27 where the protrusions 29 side is designed to be positioned adjacent to the countertop surface 14 and the cavities 31 side is designed to be facing away from the countertop surface 14.

Operation of the Fourth Embodiment

The operation of the fourth embodiment is the same as the second embodiment with the exception that sheet 26 is replaced with sheet 27.

Fifth Embodiment—FIG. 1, FIG. 2, FIG. 3, FIG. 7, FIG. 8 and FIG. 9

Referring to FIG. 1, FIG. 2, FIG. 3, FIG. 7, FIG. 8 and FIG. 9, a fifth embodiment of the present invention is shown, which can be used for adhering the apparatus of the invention to a surface 14. The fifth embodiment relates to a method of buffering the surface 14 of a countertop on a cabinet 10 while at the same time maintaining the surface's 14 visual appearance. The fifth embodiment is the same as the first embodiment with the exception that sheet 12 is replaced with sheet 27 and the protrusions 29 side is positioned adjacent to the countertop surface 14 with the cavities 31 side orientated away from the countertop surface 14.

Sixth Embodiment—FIG. 5, FIG. 6, FIG. 8, FIG. 9, FIG. 10 and FIG. 11

Figure 10:
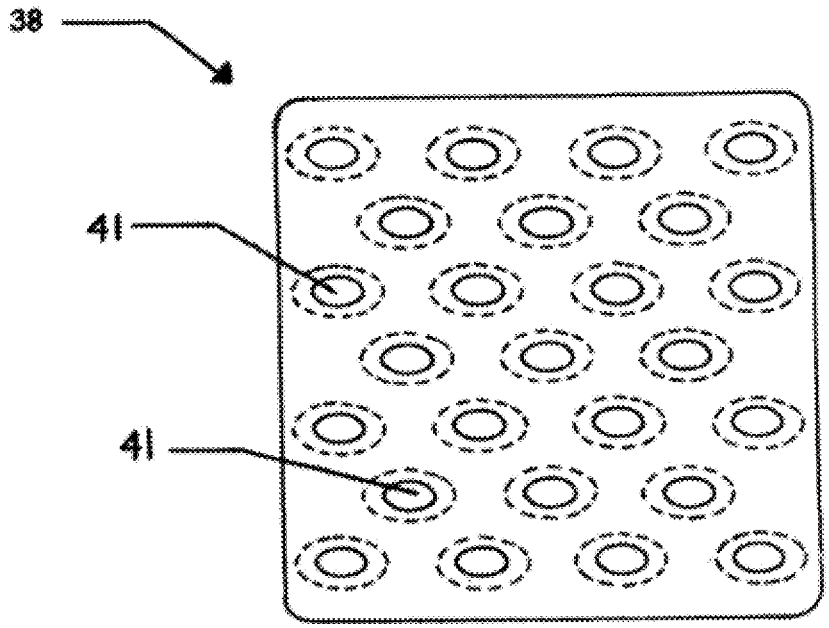
FIG. 10 is a first surface view of a silicone sheet of the present invention having substantially elliptical concave cavities and corresponding convex protrusions with the cavities facing upward.
Figure 11:
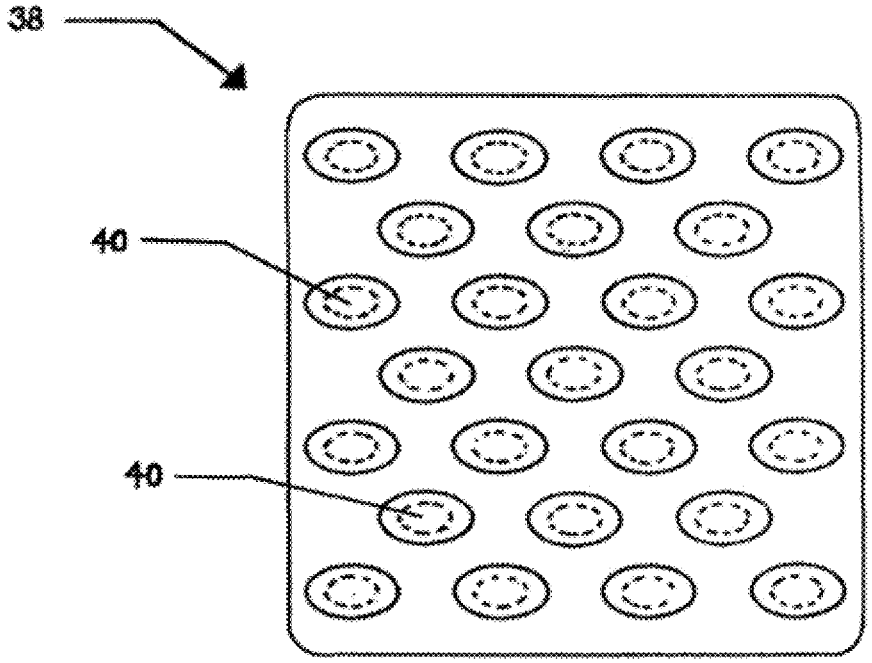
FIG. 11 is a second surface view of the silicone sheet shown in FIG. 10 showing the convex protrusions facing upward.
Figure 12:
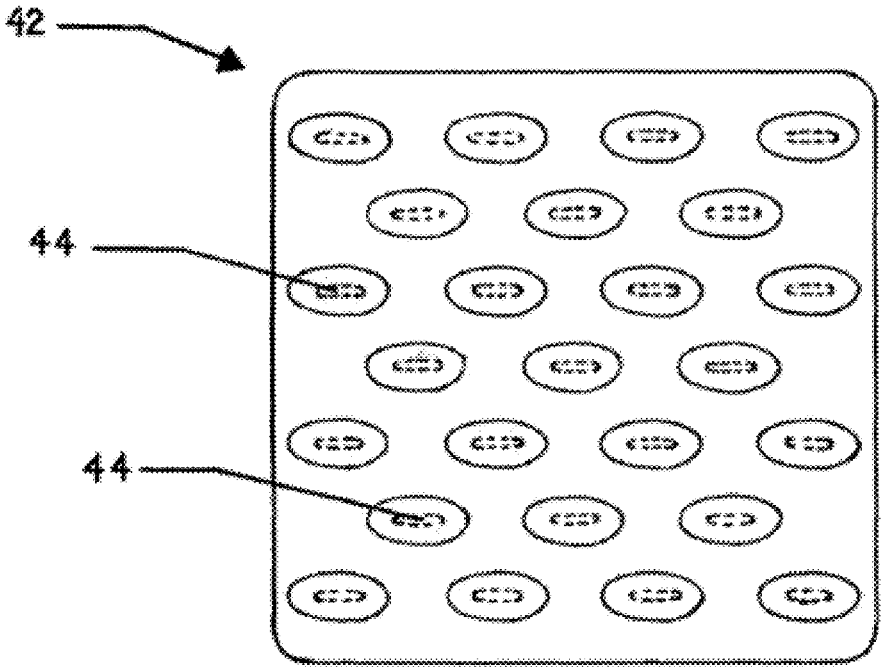
FIG. 12 is a first surface view of a silicone sheet of the present invention having substantially elliptical concave cavities and corresponding convex protrusions, different from those shown in FIG. 10, with the protrusions facing upward.
Figure 13:
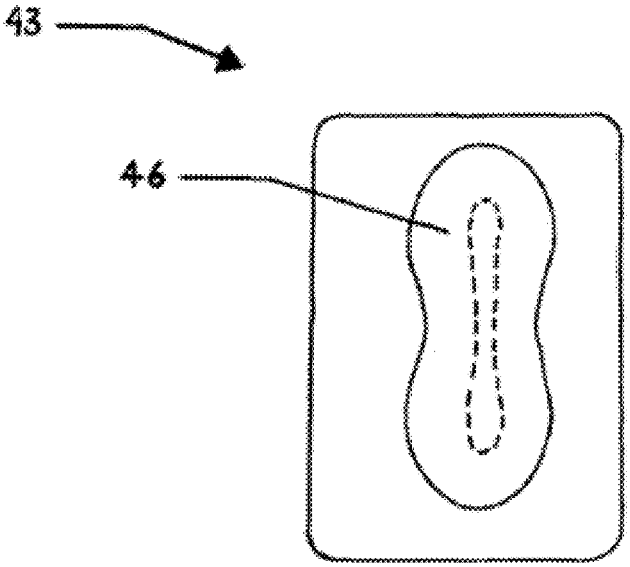
FIG. 13 is a first surface view of a protrusion of the present invention with a corresponding concave pocket having a shape different from those shown in FIGS. 4-11. The protrusion is shown facing upward.
Figure 14:
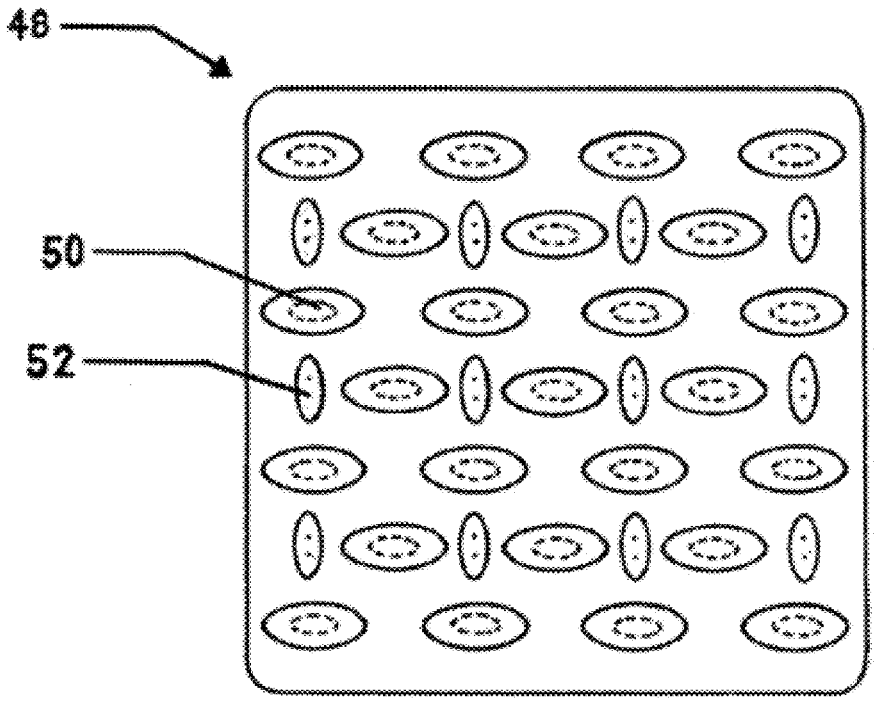
FIG. 14 is a first surface view of a silicone sheet of the present invention having concave cavities and corresponding convex protrusions with mixed shapes of different orientations with the protrusions facing upward.

Referring to FIG. 5, FIG. 6, FIG. 8, FIG. 9, FIG. 10 and FIG. 11, a sixth embodiment of the present invention is shown, which can be used for adhering the apparatus of the invention to a surface 14. The sixth embodiment is a device for buffering the surface 14 of a countertop on a cabinet 10 while at the same time maintaining the surface's 14 visual appearance. The sixth embodiment is the same as the second embodiment with the exception that sheet 26 is replaced with sheet 38. In the sixth embodiment, the sheet 38 can be designed such that the protrusions 41 side is positioned adjacent to the countertop surface 14, as shown in FIG. 10 or the sheet 38 can be designed so that the cavities 40 side is positioned adjacent to the countertop surface 14, as shown in FIG. 11. The cross sections of sheet 38 may be similar to those shown in FIG. 5, FIG. 6, FIG. 8, FIG. 9, FIG. 10 and FIG. 11.

Operation of the Sixth Embodiment

The operation of the sixth embodiment is the same as the second embodiment with the exception that sheet 26 is replaced with sheet 38 and the appropriate side of sheet 38 is positioned adjacent to the countertop surface 14.

Seventh Embodiment—FIG. 1, FIG. 2, FIG. 3, FIG. 10 and FIG. 11

Referring to FIG. 1, FIG. 2, FIG. 3, FIG. 10 and FIG. 11, a seventh embodiment of the present invention is shown, which can be used for adhering the apparatus of the invention to a surface 14. The seventh embodiment relates to a method of buffering the surface 14 of a countertop on a cabinet 10 while at the same time maintaining the surface's 14 visual appearance. The seventh embodiment is the same as the first embodiment with the exception that sheet 12 is replaced with sheet 38 and the appropriate side of sheet 38 (reference the sixth embodiment) is positioned adjacent to the countertop surface 14.

Eighth Embodiment—FIG. 5, FIG. 6, FIG. 8, FIG. 9, and FIG. 12

Referring to FIG. 5, FIG. 6, FIG. 8, FIG. 9, and FIG. 12, an eighth embodiment of the present invention is shown, which can be used for adhering the apparatus of the invention to a surface 14. The eighth embodiment is a device for buffering the surface 14 of a countertop on a cabinet 10 while at the same time maintaining the surface's 14 visual appearance. The eighth embodiment is the same as the second embodiment with the exception that sheet 26 is replaced with sheet 42 and either the protrusions 44 side or the corresponding cavities side, as dependent on the applicable design (reference the second embodiment), is positioned adjacent to the countertop surface 14.

The cross sections of sheet 42 may be similar to those shown in FIG. 5, FIG. 6, FIG. 8 and FIG. 9.

Operation of the Eighth Embodiment

The operation of the eighth embodiment is the same as the second embodiment with the exception that sheet 26 is replaced with sheet 42.

Ninth Embodiment—FIG. 1, FIG. 2, FIG. 3 and FIG. 12

Referring to FIG. 1, FIG. 2, FIG. 3 and FIG. 12, a ninth embodiment of the present invention is shown, which can be used for adhering the apparatus of the invention to a surface 14. The ninth embodiment relates to a method of buffering the surface 14 of a countertop on a cabinet 10 while at the same time maintaining the surface's 14 visual appearance. The ninth embodiment is the same as the first embodiment with the exception that sheet 12 is replaced with sheet 42. Furthermore, similar to the second embodiment, either the protrusions 44 side or the corresponding cavities side, as dependent on the applicable design (reference the second embodiment), is positioned adjacent to the countertop surface 14.

Tenth Embodiment—FIG. 5, FIG. 6, FIG. 8, FIG. 9, and FIG. 13

Referring to FIG. 5, FIG. 6, FIG. 8, FIG. 9, and FIG. 13, a tenth embodiment of the present invention is shown, which can be used for adhering the apparatus of the invention to a surface 14. The tenth embodiment is a device for buffering the surface 14 of a countertop on a cabinet 10 while at the same time maintaining the surface's 14 visual appearance. The tenth embodiment is the same as the second embodiment with the exception that each protrusion 28 and its corresponding pocket 30 of sheet 26 are replaced with the protrusion 46 and its corresponding pocket. The cross sections of sheet 26, as modified, may be somewhat similar to those shown in FIG. 5, FIG. 6, FIG. 8 and FIG. 9 with the replaced pocket 46.

Operation of the Tenth Embodiment

The operation of the tenth embodiment is the same as the second embodiment with the exception that sheet 26 is replaced with a modified sheet with cavity 46.

Eleventh Embodiment—FIG. 1, FIG. 2, FIG. 3 and FIG. 13

Referring to FIG. 1, FIG. 2, FIG. 3 and FIG. 13, an eleventh embodiment of the present invention is shown, which can be used for adhering the apparatus of the invention to a surface 14. The eleventh embodiment relates to a method of buffering the surface 14 of a countertop on a cabinet 10 while at the same time maintaining the surface's 14 visual appearance. The eleventh embodiment is the same as the first embodiment with the exception that sheet 12 is replaced with the modified sheet as described in the tenth embodiment. Also, as described in the second embodiment, either the protrusion 46 side or the corresponding cavity side, as dependent on the applicable design (reference the second embodiment), is positioned adjacent to the countertop surface 14.

Twelfth Embodiment—FIG. 5, FIG. 6, FIG. 8, FIG. 9, and FIG. 14

Referring to FIG. 5, FIG. 6, FIG. 8, FIG. 9, and FIG. 14, a twelfth embodiment of the present invention is shown, which can be used for adhering the apparatus of the invention to a surface 14. The twelfth embodiment is a device for buffering the surface 14 of a countertop on a cabinet 10 while at the same time maintaining the surface's 14 visual appearance. The twelfth embodiment is the same as the second embodiment with the exception that sheet 26 is replaced with sheet 48. The cross sections of sheet 48 may be somewhat similar to those shown in FIG. 5, FIG. 6, FIG. 8 and FIG. 9.

Operation of the Twelfth Embodiment

The operation of the twelfth embodiment is the same as the second embodiment with the exception that sheet 26 is replaced with sheet 48.

Thirteenth Embodiment—FIG. 1, FIG. 2, FIG. 3 and FIG. 14

Referring to FIG. 1, FIG. 2, FIG. 3 and FIG. 14, a thirteenth embodiment of the present invention is shown, which can be used for adhering the apparatus of the invention to a surface 14. The thirteenth embodiment relates to a method of buffering the surface 14 of a countertop on a cabinet 10 while at the same time maintaining the surface's 14 visual appearance. The thirteenth embodiment is the same as the first embodiment with the exception that sheet 12 is replaced with sheet 48. Furthermore, similar to the second embodiment, either the protrusions 50 and 52 side and their corresponding cavities side, as dependent on the applicable design (reference the second embodiment), is positioned adjacent to the countertop surface 14.

Fourteenth Embodiment—FIG. 5, FIG. 6, FIG. 8, FIG. 9, and FIG. 15

Figure 15:
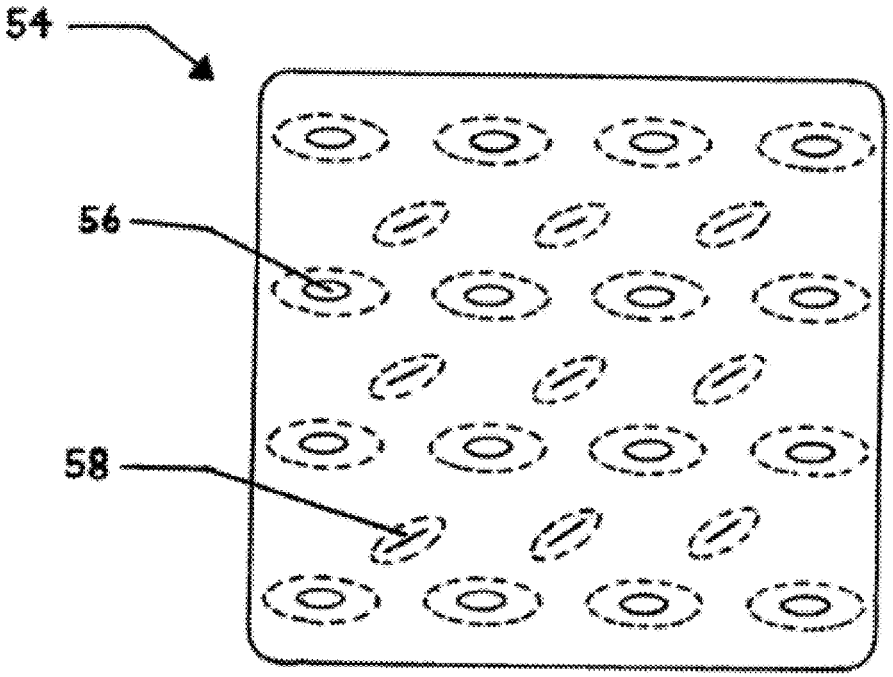
FIG. 15 is a first surface view of a silicone sheet of the present invention having concave cavities with corresponding convex protrusions with mixed shapes of different orientations with the cavities facing upward.
Figure 16:
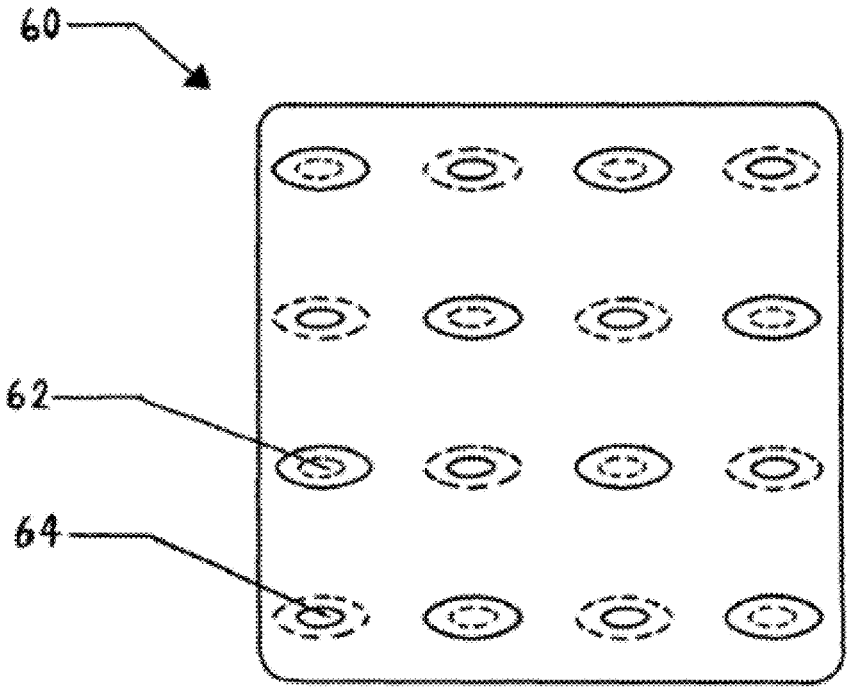
FIG. 16 is a first surface view of a silicone sheet of the present invention having both concave cavities with corresponding convex protrusions and protrusions with corresponding cavities on both its first and second sides.

Referring to FIG. 5, FIG. 6, FI G. 8, FIG. 9, and FIG. 15, a fourteenth embodiment of the present invention is shown, which can be used for adhering the apparatus of the invention to a surface 14. The fourteenth embodiment is a device for buffering the surface 14 of a countertop on a cabinet 10 while at the same time maintaining the surface's 14 visual appearance. The fourteenth embodiment is the same as the second embodiment with the exception that sheet 26 is replaced with sheet 54. Note that the concave cavities 56 and 58 are facing upward in FIG. 15 and that the depth of the cavities 58 terminate at a ridge and not flat, therefore their end is shown as a straight line. The cross sections of sheet 54 may be somewhat similar to those shown in FIG. 5, FIG. 6, FIG. 8 and FIG. 9.

Operation of the Fourteenth Embodiment

The operation of the fourteenth embodiment is the same as the second embodiment with the exception that sheet 26 is replaced with sheet 54.

Fifteenth Embodiment—FIG. 1, FIG. 2, FIG. 3 and FIG. 15

Referring to FIG. 1, FIG. 2, FIG. 3 and FIG. 15, a fifteenth embodiment of the present invention is shown, which can be used for adhering the apparatus of the invention to a surface 14. The fifteenth embodiment relates to a method of buffering the surface 14 of a countertop on a cabinet 10 while at the same time maintaining the surface's 14 visual appearance. The fifteenth embodiment is the same as the first embodiment with the exception that sheet 12 is replaced with sheet 54. Furthermore, similar to the second embodiment, either the cavities 56 and 58 side or the corresponding protrusions side, as dependent on the applicable design (reference the second embodiment), is positioned adjacent to the countertop surface 14.

Sixteenth Embodiment—FIG. 5, FIG. 6, FIG. 8, FIG. 9, and FIG. 16

Referring to FIG. 5, FIG. 6, FIG. 8, FIG. 9, and FIG. 16, a sixteenth embodiment of the present invention is shown, which can be used for adhering the apparatus of the invention to a surface 14. The sixteenth embodiment is a device for buffering the surface 14 of a countertop on a cabinet 10 while at the same time maintaining the surface's 14 visual appearance. The sixteenth embodiment is the same as the second embodiment with the exception that sheet 26 is replaced with sheet 60. Note that sheet 60 has both concave cavities 64 with corresponding convex protrusions 62, and protrusions 62 with corresponding cavities 64 on both its first and second sides.

Operation of the Sixteenth Embodiment

The operation of the sixteenth embodiment is the same as the second embodiment with the exception that sheet 26 is replaced with sheet 60. Note that the first side of sheet 60 can be specifically designed to be positioned on the countertop surface 14 or the second side of sheet 60 can be specifically designed to be positioned on the countertop surface 14.

Figure 17:
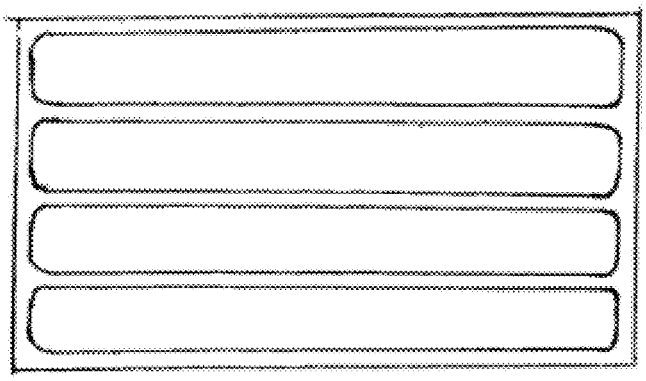
FIG. 17 is an alternative embodiment of the invention.

FIG. 17 is an upper surface view of a silicone sheet of the present invention having concave cavities facing up with corresponding convex protrusions that form more than one channel.

Figure 18:
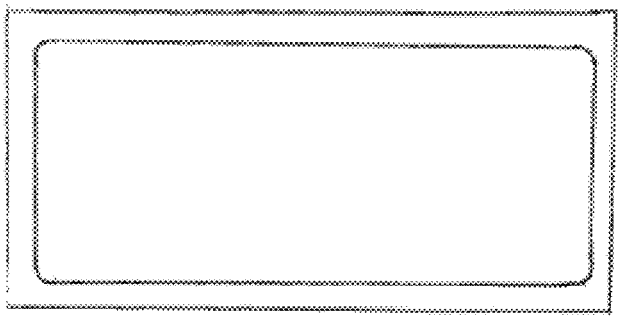
FIG. 18 is an alternative embodiment of the invention.

FIG. 18 is an upper surface view of a silicone sheet of the present invention having a concave cavity facing up with a corresponding convex protrusion that runs from one end of the silicone sheet to the other.

Figure 19:
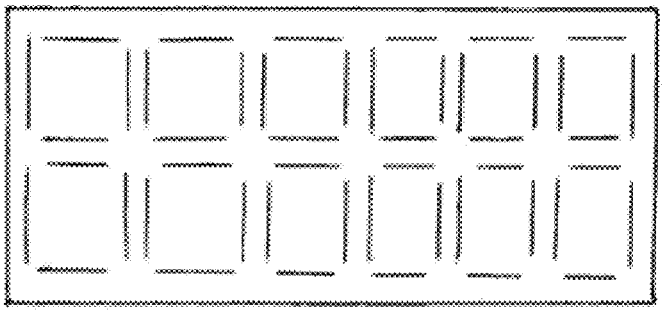
FIG. 19 is an alternative embodiment of the invention.

FIG. 19 is an upper surface view of a silicone sheet of the present invention having concave cavities facing up with corresponding convex protrusions of a cavity within a section, with multiple sections.

FIG. 20 is an upper surface view of a silicone sheet of the present invention having concave cavities facing up with corresponding convex protrusions that are angled.

FIG. 21 is an upper surface view of a silicone sheet of the present invention having concave cavities facing up with corresponding convex protrusions.

FIG. 22 is an upper surface view of a silicone sheet of the present invention having concave cavities facing up with corresponding convex protrusions that form an adapted chevron with cavities and protrusions that are open on one side.

FIG. 23 is an upper surface view of a silicone sheet of the present invention having concave cavities facing up with corresponding convex protrusions that are random shapes.

FIG. 24 is an upper surface view of a silicone sheet of the present invention having concave cavities facing up with corresponding convex protrusions that touch at the end.

FIG. 25 is an upper surface view of a silicone sheet of the present invention having concave cavities facing down with corresponding convex protrusions.

FIG. 26 is an upper surface view of a silicone sheet of the present invention having a concave cavity facing up with a corresponding convex protrusion in the shape of a wave.

FIG. 27 is an upper surface view of a silicone sheet of the present invention having concave cavities facing down with corresponding convex protrusions.

FIG. 28 is an upper surface view of a silicone sheet of the present invention having concave cavities facing up with corresponding convex protrusions of a random design, different from FIG. 23.

Conclusion, Ramifications, and Scope

Thus, a person of ordinary skill in the art will understand that the Device and Method for Buffering a Surface While Maintaining the Surface's Visual Appearance is simple, user friendly, inexpensive, as well as reliable and has many advantages, features, and benefits over the prior art.

While the aforementioned descriptions of the embodiments contain many specifics, these specifics should not be construed as limitations on the scope of the disclosed invention, but rather as an exemplification of several preferred embodiments thereof.

Many other ramifications, variations, alterations, substitutions, modifications, and the like are readily possible. For example, sizes, shapes, procedures, design, etc. of all components can be readily modified or changed.

For example, (1) the countertop surface can be any type of generic surface used to place items on; (2) the generic surface can have any text, graphic, design, or other embellishment that can be shown through the sheet after the sheet has been applied to the generic surface; (3) one or both surfaces of the sheet can have texture, lines, or any shapes (e.g., a texture similar to sandpaper can be used to prevent or reduce slippage or sticking of utensils placed thereupon); (4) in the unflattened state, the thickness of the sheet between the peak of a protrusion and the peak of its corresponding cavity can be different from the thickness of a flat portion of the sheet (e.g., greater than or less than the thickness of the flat portion); (5) in the unflattened state, the thickness of the sheet between the protrusions and corresponding cavities can vary; (6) the thickness of the flat portions of the sheet can vary; (7) in the flattened state, the thickness of the sheet can be substantially uniform (e.g., the sheet is substantially planar), or the thickness of the sheet can vary (e.g., the sheet is non-planar); (8) the peaks of the protrusions do not have to be flat, but can be domed or spherical shaped; (9) the protrusions and their corresponding cavities can have any shape or configuration different from those shown in the various embodiments; (10) the sheet can have both protrusions and cavities of any configuration on the same side of the sheet; (11) the sheet can have protrusions with corresponding cavities of any shape, width/length, and height and can be intermixed with protrusions and cavities having different shapes, widths/lengths, and heights; (12) the sheet can have just one protrusion and corresponding cavity, or can have multiple protrusions and corresponding cavities; (13) the protrusions and correspond cavities can be distributed evenly throughout the sheet or be distributed randomly throughout the sheet; (14) excess air, excess wetting agent, or both excess air and wetting agent can be removed by moving any flat and/or curved object on the sheet with a sufficient force directed toward the sheet; (15) the material used in the sheet can have anti-bacterial, anti-microbial, and/or anti-pathogenic constituents; (16) the material used in the sheet can be any deformable, malleable, and/or flexible, material such as silicone, rubber, vinyl, flexible films, etc., and can have any softness, resiliency and/or tensile strength; (17) the sheet can be transparent, translucent or semi-transparent, or opaque; (18) the sheet can be of any color; (19) the sheet can have a tint and may provide UV protection; and/or (20) the sheet can have a thickness of 4 mm or less, or greater than 4 mm (e.g., between 4 mm and 50 mm, or between 40 mm and 100 mm, etc.).

With respect to the present invention, silicone is further defined as any material that is resiliently deformable, heat resistant and substantially transparent in a similar measure to these qualities of silicone.

The main purpose of the apparatus according to some embodiments including each of those described above with respect to FIGS. 1-29 is to achieve an adherence function to attach the apparatus to an object or a surface. Although some embodiments may use a wetting agent to adhere the apparatus to the object or a surface, it should be understood that a wetting agent need not be used. In some embodiments, the apparatus can be used to achieve a secondary function of protection as described above. Furthermore, the apparatus need not be in the form of a sheet, and can take on other form factors or can be integrated as part of one object that adheres to another 16 object. Additionally, any of the variations and/or modifications described herein with respect to the sheet can also be applicable to other form factors that are not necessarily in the form of a sheet. An appendage can also be formed out of the apparatus itself or an appendage can be attached to the apparatus. It should also be understood that other techniques for flattening the apparatus to cause the apparatus to adhere to an object or surface can be used.

The material portions between the concave cavities and corresponding convex protrusions can have a thickness of 4 mm or less, or can have a thickness of greater than 4 mm (e.g., between 4 mm and 50 mm, or between 40 mm and 100 mm, etc.). A thickness of the apparatus at the material portions can be different than the thickness at the concave cavities and corresponding convex protrusions. For example, the thickness of the apparatus at the material portions can be greater than the thickness at the concave cavities and corresponding convex protrusions. The thickness of the apparatus at the material portions can alternatively be less than the thickness at the concave cavities and corresponding convex protrusions. The material portions of the apparatus can extend continuously between adjacent concave cavities and corresponding convex protrusions. The material portions of the apparatus may have different elevations. The concave cavities and corresponding convex protrusions may also have different elevations. The apparatus may also include one or more cutouts at suitable locations. The concave cavity and corresponding convex protrusion, or concave cavities and corresponding convex protrusions can be distributed evenly throughout the apparatus or be distributed randomly throughout the apparatus, or in any order, number, size, location, or fashion depending on the application, or can be arranged anywhere on the apparatus.

The material used in the apparatus can have anti-bacterial, anti-microbial, and/or anti-pathogenic constituents. The material used in the apparatus can be any deformable, malleable, and/or flexible, material such as silicone, rubber, vinyl, flexible films, plastic, etc., and can have any softness, resiliency and/or tensile strength. Furthermore, a heat resistant material need not be used. The apparatus can be transparent, translucent, semi-transparent, semi-opaque, or opaque. The apparatus can be of any shape, color, or design, or the apparatus can include any coating or embellishment. The apparatus can have a tint and may provide UV protection.

In some embodiments, once the apparatus adheres to an object or surface by removing the excess air and/or excess wetting agent if used to flatten the concave cavities and corresponding convex protrusions against the object or surface, the apparatus can remain adhered to the object or surface without requiring an external force to be maintained on the apparatus. The apparatus can be removed from the object or surface by easily peeling the apparatus off of the object or surface. In some embodiments, if a semi-permanent bonding is desired, a sticky substance or another bonding agent can be applied on the perimeter and/or elsewhere on the apparatus for a semi-permanent bonding of the apparatus to the object or surface. In some embodiments, clips, snaps, screws, or other types of hardware fasteners can also be used to secure the apparatus to the object or surface, in addition to using the concave cavities and corresponding convex protrusions to adhere the apparatus to the object or surface.

In some embodiments, after the one or more concave cavities and corresponding convex protrusions have been flattened to cause the apparatus to adhere to the object or surface, the apparatus may have a substantially uniform thickness. For example, the surface of the apparatus opposing the object or surface can be made substantially flat and planar if the apparatus is adhered to a flat surface of the object. To achieve this, the apparatus may include material portions that have a uniform thickness surrounding the concave cavities and corresponding convex protrusions. The thickness of the curved portions (concave cavities and corresponding convex protrusions) can be designed such that the volume of material forming the curved portions (concave cavities and corresponding convex protrusions) in their unflattened state is consistent with the uniform thickness of the surrounding material portions once the curved portions (concave cavities and corresponding convex protrusions) are flattened against the object or surface. In some embodiments, the apparatus may have a contour (which may have a uniform or varying thickness) that corresponds to the contour of the object or surface.

Figure 29A:
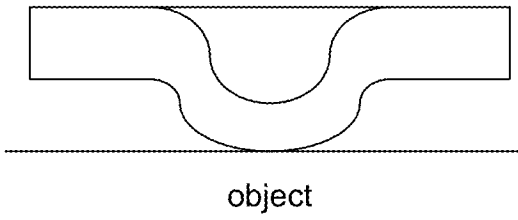
FIG. 29A illustrates an apparatus with a protrusion facing down prior to being applied to the surface of an object below, according to some embodiments.
Figure 29B:
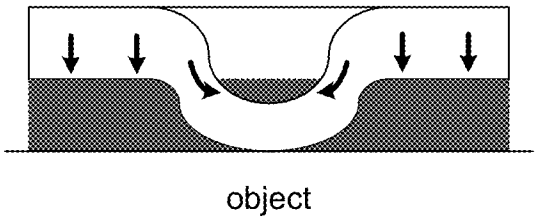
FIG. 29B illustrates the movement of material of an apparatus with a protrusion facing down as it is being applied to the surface of an object below, according to some embodiments.
Figure 29C:
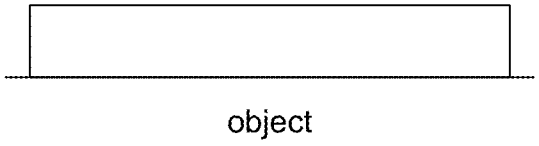
FIG. 29C illustrates an apparatus with a protrusion facing down after being applied to the surface of an object below, according to some embodiments.

An example of such a design is shown in FIG. 29A-C. FIG. 29A illustrates a cross section of the location of a curved portion (e.g., protrusion facing down) of the apparatus prior to adhering the apparatus onto a surface of an object below. As shown in FIG. 29A, the thickness of the material portion surroundings the curved portion is greater than the thickness of the curved portion. The shaded areas shown in FIG. 29B indicate voids that the material will occupy after the apparatus has been flattened to achieve a uniform thickness, and the arrows indicate the direction the material will move as it is being flattened. As shown in FIG. 29B, depending upon the geometry of the curved portions, in order for the volume of material to fit into the shaded areas, the thickness of the material at the curved portion is made thinner than the thickness at the material portions surrounding the curved portion, because more surface area of material is required to form the curved portion as compared to the material portion surrounding the curved portion of the apparatus. Because of the greater amount of surface area at the curved portion, the thickness of material at the curved portion is reduced to maintain the same volume of material as compared to a planar layer. In this manner, after the apparatus has been flattened as shown in FIG. 29C, a uniform thickness can be achieved.

In some embodiments, the surface of the apparatus opposing the object or surface may not be flat after the apparatus has been applied to the object or surface (which itself may or may not be flat). For example, the surrounding material portions of the apparatus between adjacent curved portions may include one or more intervening uneven portions to create an uneven surface, and the uneven surface may remain after the curved portions are flattened to adhere the apparatus to an object or surface. The uneven surface can act, for example, as an anti-slip surface. The apparatus can also have a texture on either side to create an uneven surface or different elevations that remain even after the curved portions are flattened to adhere the apparatus to an object or surface. In some embodiments, the apparatus may include one or more appendages on the first surface of the apparatus (e.g., the surface opposing the surface that adheres to the object). One or more appendages can be used, some of which may include an extension, or can form a receptacle for holding an item. In some embodiments, the one or more appendages can be made of the same material as the rest of the apparatus, and the apparatus including the one or more appendages can be formed using a monolithic construction technique. In some embodiments, the one or more appendages can be made of the same or different material as the rest of the apparatus, and can be bonded or secured to the surface away from the object or generic surface. In some embodiments, the one or more appendages may include three-dimensional shapes or designs. In some embodiments, one or more appendages may include textual, graphic, or other design information or embellishments on them.

In some embodiments, the apparatus may include a layer made of a secondary material that is attached or bonded to the surface of the apparatus opposing the surface that adheres to the object or surface. The layer of secondary material may include a fabric material (e.g., a textile), a flexible material that may provide additional cushion or texture such as material with a foam-like structure, a material with texture to prevent slippage or to provide traction, or a faux wood texture, or other textures, etc. In some embodiments, there can be multiple layers of secondary materials, and the different layers can be made of the same or different materials, and can be attached or boned to each other. The one or more secondary material can provide additional functionality to the apparatus. In some embodiments, the apparatus may include a printed material (e.g., for signage, decoration, etc.) that is visible from the surface of the apparatus opposing the surface that adheres to the object, or the signage may attach to the outer surface of the apparatus. In some embodiments, the apparatus may include a coating to provide additional functionality (e.g., to provide a sticky surface for other objects to stick to the apparatus, or for the apparatus to stick to other objects, etc.). In some embodiments, the apparatus can be reversible, and in some embodiments, the apparatus can be used to adhere two objects together with the apparatus sandwiched between the two objects.

In some embodiments, the apparatus may be in the form of a strip of material, and may include one or more concave cavities and corresponding convex protrusions proximate to each end of apparatus. The apparatus may also include one or more concave cavities and corresponding convex protrusions elsewhere on the apparatus. The one or more concave cavities and corresponding convex protrusions at one end of the apparatus can be flattened to adhere that end of the apparatus to an object. The apparatus can then be wound around the object such that the apparatus overlap itself, and the one or more concave cavities and corresponding convex protrusions at the other end of the apparatus can be flattened to secure the apparatus onto itself, or to another part of the object, or to another object. In some embodiments, the apparatus can be bonded, sewn, riveted, or otherwise be attached to an item, and the apparatus can be wrapped around an object as discussed above to couple the object to the item.

It should be understood that the apparatus having one or more flattenable concave cavities and corresponding convex protrusions can be useful in various environments and fields. For example, the apparatus can be used for personal and household applications; commercial applications such as in a business or office; industrial, mechanical, scientific, or medical applications; athletic or sports applications, construction and building applications, and/or other applications where an apparatus that adheres to an object is desired. The apparatus can also adhere to a wide range of objects and surfaces of various materials, some of which can be, for example, metal, cement, natural stone, ceramic, porcelain, glass, linoleum, plastic, wood, rubber, paper-based surfaces, fibrous surfaces, and/or other hard or soft surfaces.

By way of example, in the context of consumer or household applications, the apparatus can adhere to the bottom of a lamp, a lazy-susan, or the back of a picture frame. The apparatus can adhere to a tabletop or countertop, and can act as a protector or buffer against pots, pans, platters, dishes, condiments, turntables, utensils, or other tableware placed on the tabletop or countertop, or other objects placed on a surface. The apparatus can be applied to both the top and sides of a waterfall style countertop to buffer countertop material (e.g., tile, granite, quartz, etc.), or be placed on the edge of a wood stove or fireplace, or other areas to provide safety for children. The apparatus can be heat-resistant (e.g., made of silicone or other heat resistance material) to withstand hot temperatures from a stove, or from contact with hot pots, pans, dishes, or a fireplace or wood stove, or it can be made of other types of malleable materials that are not heat resistance when heat resistance is not necessary. The apparatus can adhere to the inside of a cabinet door to act as a bumper. The apparatus can adhere to the base of a drawer or shelf and be used as a drawer liner, or it can be formed with one or more appendages and be used as a drawer divider, or the apparatus can adherer to the bottom of a standard drawer divider to stabilize it to the base of the drawer. The apparatus can adhere to the edge of a bed rack to hold a box-spring in place, or it can be formed as an exercise pad that can adhere to a floor. The apparatus can adhere to a surface or object to prevent the object from sliding or moving. The apparatus can be formed with appendages to hold an item in place while adhering to an object or a surface such as a penholder to a desk. The apparatus can adhere to two objects on opposing sides of the apparatus to secure the two objects with each other such as to secure a lamp onto a table, and may be useful, for example, in earthquake preparedness.

In the context of applications in various industries, the apparatus can be used as a placard or a sign that adheres to a board or a wall to convey information, and to provide signage for use by realtors, advertisers, construction workers, schools, etc. The apparatus can be used to adhere sections of carpet, tile, wood planks, or other building materials to a floor or a wall. The apparatus can be used to adhere a film to the roof or siding of a structure as a protective layer to protect the structure from the elements, or as a functional layer or design layer for structure. The apparatus can be used inside the structure to provide a design element, or other function. The apparatus can be used to adhere a layer of material to a submersible object such as the hull of a boat to protect it from deterioration. The apparatus can adhere to a glass panel and be used as a cushion to protect the glass from breakage. The apparatus can include a tint or colored film to provide a hue and/or UV protection for windows or auto-glass. The apparatus can be tinted and adhere to lighting equipment to provide a hue for photography, a theatrical setting, a dance floor, ambience or mood lighting, or to project text or a design furnished from the apparatus. The apparatus can be sandwiched between two metal components (e.g., metal cylinders, which in this case the adherence can be augmented to be made semi-permanent with the use of clips or other hardware, a sticky substance or other bonding agent around the perimeter or elsewhere on the apparatus) to prevent friction and to protect the metal components. The apparatus can be used in a laboratory, and placed on a slide to contain a liquid or an item placed on a slide, etc., or to stabilize laboratory equipment, medical equipment and tools, etc. to a work surface.

While a number of exemplary aspects and embodiments have been discussed above, those skilled in the art will recognize certain modifications, permutations, additions and sub-combinations thereof. It is therefore intended that the following appended claims are interpreted to include all such modifications, permutations, additions and sub-combinations as are within their true spirit and scope.

Accordingly, the scope and meaning should be determined not only by the embodiments illustrated, but by the appended claims and their legal equivalents.

What is claimed is:

1. A device comprising:

a sheet having a first surface and a second surface such that said first surface and said second surface are substantially opposite each other, said first surface having a first plurality of concave cavities and said second surface having a first plurality of convex protrusions corresponding to said first plurality of concave cavities;

wherein a height of said concave cavities corresponds to a height of said convex protrusions throughout said sheet;

wherein a width of said concave cavities corresponds to a width of said convex protrusions throughout said sheet;

wherein said concave cavities and said convex protrusions throughout said sheet are configured to be flattened to cause said sheet to adhere to an object by removing at least one of excess air, or excess wetting agent, if used, disposed between the second surface of said sheet and the object, and wherein the second surface is facing the object; and a secondary material that is bonded to the first or second surface of the sheet using a bonding agent.

2. The device as defined in claim 1 wherein said sheet has a thickness of 4 mm or less.

3. The device as defined in claim 1 wherein said sheet has a thickness of greater than 4 mm.

4. The device as defined in claim 1 wherein one or both of said first surface and said second surface has texture.

5. The device as defined in claim 1 wherein said sheet has a second plurality of convex protrusions on said first surface, and a second plurality of concave cavities on said second surface, said second plurality of concave cavities corresponding to said second plurality of convex protrusions.

6. A device comprising:

a sheet having a first surface and a second surface such that said first surface and said second surface are substantially opposite each other, said first surface having a first plurality of concave cavities and said second surface having a first plurality of convex protrusions corresponding to said first plurality of concave cavities, wherein a height of said concave cavities corresponds to a height of said convex protrusions throughout said sheet, wherein a width of said concave cavities corresponds to a width of said convex protrusions throughout said sheet, wherein said concave cavities and said convex protrusions throughout said sheet are configured to be flattened to cause said sheet to adhere to an object by removing at least one of excess air, or excess wetting agent, if used, disposed between the second surface of said sheet and the object, and wherein the second surface is facing the object;

wherein said sheet has a material adjacent to said first plurality of concave cavities and corresponding said first plurality of convex protrusions, and wherein a thickness of said material is greater than a thickness between each concave cavity of said first plurality of concave cavities and each corresponding convex protrusion of said first plurality of convex protrusions.

7. The device as defined in claim 6, wherein said sheet is configured to have a substantially uniform distance throughout said sheet between the first surface of said sheet and the object after said sheet is adhered to the object by flattening said concave cavities and said convex protrusions.

8. The device as defined in claim 1, wherein said sheet contains at least one of an anti-bacterial, anti-microbial, or anti-pathogenic constituent.

9. The device as defined in claim 1, wherein said sheet is opaque or semi-opaque.

10. The device as defined in claim 1, wherein said sheet is translucent or transparent.

11. The device as defined in claim 1, wherein a transition from said concave cavities and convex protrusions forms a flattened "S" shape configured to be flattened to cause said sheet to adhere to the object by removing the excess air between said sheet and the object.

12. The device as defined in claim 1, wherein said sheet provides UV protection.

13. A device comprising:

a sheet having a first surface and a second surface opposite said first surface; a plurality of concave cavities formed on said first surface; and a plurality of convex protrusions formed on said second surface wherein each concave cavity is formed within a corresponding convex protrusion, wherein said sheet has material surrounding said concave cavities and convex protrusions, wherein said sheet has at least two discrete portions, a first of said discrete portions comprising a first corresponding concave cavity and convex protrusion, and a second of said discrete portions comprising a second corresponding concave cavity and convex protrusion, said discrete portions being separated from each other by said material, wherein a thickness of said material is less than or greater than a thickness of the sheet at the first and second discrete portions, wherein a transition from said concave cavities and convex protrusions to said material forms a flattened "S" shape, and wherein said concave cavities and convex protrusions are configured to be flattened to make said sheet adhere to a surface by removing at least one of excess air, or excess wetting agent, if used, disposed between said sheet and the surface; and one or more appendages.

14. The device as defined in claim 13, wherein the thickness of said material surrounding said concave cavities and convex protrusions is greater than the thickness between said concave cavities and convex protrusions throughout said sheet.

15. The device as defined in claim 13, wherein at least one of said concave cavities and at least one of said corresponding convex protrusions have at least one of a different shape, width, and height than another one of said concave cavities and corresponding convex protrusions.

16. The device as defined in claim 13, wherein said sheet has different elevations.

17. The device as defined in claim 13, wherein said sheet has a second plurality of convex protrusions on said first surface, and a second plurality of concave cavities on said second surface, said second plurality of concave cavities corresponding to said second plurality of convex protrusions.

18. A device comprising:

a sheet having a first surface and a second surface such that said first surface and said second surface are substantially opposite each other, said first surface having at least one concave cavity and said second surface having at least one convex protrusion corresponding to said at least one concave cavity, said at least one concave cavity formed within said at least one convex protrusion, wherein a height of said at least one concave cavity corresponds to a height of said at least one convex protrusion, wherein a width of said at least one concave cavity corresponds to a width of said at least one convex protrusion, wherein said sheet has a material surrounding said at least one concave cavity and said at least one convex protrusion, and wherein said at least one concave cavity and said at least one convex protrusion are configured to be flattened to cause said sheet to adhere to a surface by removing at least one of excess air, or excess wetting agent, if used, disposed between said sheet and the surface; and wherein said sheet includes one or more cutouts.

19. The device as defined in claim 18, wherein said sheet is reversible.

20. The device as defined in claim 18, wherein said first surface is configured to be positioned adjacent to the surface and said second surface is designed to be positioned away from the surface.

21. The device as defined in claim 18, wherein said second surface is configured to be positioned adjacent to the surface and said first surface is designed to be positioned away from the surface.

22. The device as defined in claim 1, wherein the secondary material comprises a plurality of layers.

23. The device as defined in claim 1, wherein the secondary material is bonded with the first surface of the sheet using the bonding agent.

24. The device as defined in claim 23, wherein each of the corresponding concave cavities and convex protrusions is a discrete portion of the sheet surrounded by a material of the sheet, the height of said concave cavities and the corresponding height of said convex protrusions measured relative to the surrounding material of the sheet.

25. The device as defined in claim 23, wherein the secondary material comprises a textile or foam bonded with the first surface of the sheet using the bonding agent.

26. The device as defined in claim 13, wherein the one or more appendages are attached with the first surface of the sheet.

27. The device as defined in claim 13, wherein the one or more appendages and the material of the sheet comprise a monolithic construction.

* * * * *